US005593273A

United States Patent [19]

Brinkman

[11] Patent Number: 5,593,273

[45] Date of Patent: Jan. 14, 1997

[54] DOUBLE FLOW TURBINE WITH AXIAL ADJUSTMENT AND REPLACEABLE STEAM PATHS AND METHODS OF ASSEMBLY

[75] Inventor: Earl H. Brinkman, Schenectady, N.Y.

[73] Assignee: General Electric Co., Schenectady, N.Y.

[21] Appl. No.: 218,772

[22] Filed: Mar. 28, 1994

[51] Int. Cl.[6] ..... F01D 05/14

[52] U.S. Cl. ..... 415/108; 415/209.2; 415/189

[58] Field of Search ..... 415/209.2, 108, 415/189, 190, 208.1; 29/889.22, 889.1

[56] References Cited

U.S. PATENT DOCUMENTS

| | | | |
|---|---|---|---|
| 4,392,778 | 7/1983 | Hess | 415/189 |
| 5,024,579 | 6/1991 | Groenendaal et al. | 415/108 |
| 5,249,918 | 10/1993 | Knorowski . | |
| 5,295,301 | 3/1994 | Knorowski | 415/108 |

FOREIGN PATENT DOCUMENTS

| | | | |
|---|---|---|---|
| 4141906 | 11/1979 | Japan | 415/108 |
| 4284104 | 10/1992 | Japan | 29/889.22 |
| 1086191 | 4/1984 | U.S.S.R. | 415/108 |

*Primary Examiner*—Edward K. Look
*Assistant Examiner*—Mark Sgantzos
*Attorney, Agent, or Firm*—Nixon & Vanderhye

[57] ABSTRACT

The reheat tub 10 in a double-flow steam turbine is provided with additional setback from the rotor buckets 16 by forming a three-part reheat tub construction including first and second discrete diaphragm segments 26*a* and third inner ring segments 28*a*. The annular arrays of these segments are dimensioned to enable greater axial spacing between the nozzles and buckets. To refurbish an in-service double-flow turbine, the damaged reheat tub is removed and cut along axial and radial part lines to form discrete first and second diaphragm segments. The diaphragm segment nozzles are then refurbished by machining an arcuate hook 46 with a tapered surface 48 on the inner ring portion. The annulus 28 is provided with a complementary hook 50 and tapered surface 52. The diaphragm and annulus segments 26*a* and 28*a* are aligned end-to-end and rotated to join the segments along the hooks.

14 Claims, 3 Drawing Sheets

DOUBLE FLOW TURBINE WITH AXIAL ADJUSTMENT AND REPLACEABLE STEAM PATHS AND METHODS OF ASSEMBLY

TECHNICAL FIELD

The present invention relate to apparatus and methods for minimizing or eliminating damage in double-flow steam turbines and particularly relates to apparatus and methods for eliminating or minimizing such damage in the steam paths of the reheat tubs of double-flow steam turbines by providing additional axial setback of the first-stage nozzles from the first-stage rotor buckets.

BACKGROUND

In steam turbines, solid particle erosion damage to both stationary and rotating components in the steam path has become a very significant problem. The problem is exacerbated as the average in-service age of the steam turbines increases. It is known that a principal source of such erosion damage is the existence of iron oxide particles in the steam resultant from the exfoliation of oxides formed on the inner surfaces of the steam boiler tubes and steam piping at elevated temperatures and which particles impact on the nozzles and buckets along the steam paths. This solid particle erosion damage in steam turbines is a major contributor to problems associated with the operation and maintenance of steam turbines, for example, those used by utilities to generate electrical power. These problems include loss of sustained efficiency, forced outages, extended maintenance outages, cost of maintenance, cost of replacement parts and shortened inspection intervals. In fact, solid particle erosion damage has become such a contributing factor in the utilization of steam turbines for the generation of electrical power that a dollar cost per kilowatt hour per year is frequently assigned to this phenomena.

Efforts, of course, have been made to minimize or eliminate this problem. One approach has been to eliminate the source of the solid particles themselves, for example, by providing a chromium diffused layer on the internal surfaces of boiler tubes to inhibit formation of the oxides. While this solution may be effective in new steam turbines, it is not applicable for practical and cost considerations to units in-service. Other attempted solutions include acid cleaning of superheaters and reheaters to remove scale from the tube surfaces, and chromating boiler tubes. However, such methods to eliminate the problem at its source have proven expensive and oftentimes not practical.

Another approach to the solid particle erosion problem has been to produce steam path designs which are effective to resist such erosion. Recent studies have shown that the location and intensity of the particles impacting on the nozzles and buckets are the leading causes of erosion. For example, in the reheat section of a turbine steam path, the nozzles erode from the suction surface, particularly along their trailing edges as a result of particle collision with a leading edge of the bucket and rebound into the nozzle trailing edge suction surface. It is also known that the nozzle erosion caused by such particle rebounding phenomena may be significantly reduced or eliminated by increasing the axial clearance between the nozzles and buckets. This increased clearance affords more time for steam to accelerate the particles as they proceed from the nozzles to the buckets and for the steam to redirect the particles back toward the buckets after collision with the bucket leading edge. Thus, steam turbines have previously been designed with increased setback of the nozzles relative to the buckets. That is, the diaphragms of steam turbines where solid particle erosion is or is anticipated to be a problem, have been moved upstream relative to the buckets to increase the axial spacing therebetween and hence minimize or eliminate the problem.

With respect to double-flow reheat turbines, however, the provision of additional setback is replete with difficulties, particularly when modifying or retrofitting an existing reheat tub to provide such additional setback. Practical problems such as imperfections in original welds, the use of filler pieces to limit welding distortion in the original fabrication and a general inability to modify various components of the double-flow tub without causing other problems, for example, relocating external cooling pipes or upsetting rotor balance access ports, presents a formidable task if additional nozzle setback is desired in double-flow reheat tubs. In U.S. Pat. No. 5,249,918, of common assignee herewith, there is disclosed apparatus and methods for providing additional setback for the steam paths of a double-flow turbine. Essentially, material is added to and removed from the downstream and upstream sides of the diaphragms to enable the diaphragms to be displaced toward one another and further away from the first-stage turbine buckets. While this has proven satisfactory, the addition of weld material requires substantial fabrication, subsequent machining and hence high costs to produce a reliable double-flow steam turbine with additional setback.

DISCLOSURE OF THE INVENTION

According to the present invention, there is provided novel and improved apparatus and methods for providing additional setback, i.e., increased axial clearance between the diaphragms and buckets of the first stages in a double-flow steam turbine. Particularly, the present invention provides a three-part reheat tub construction for the first stages of a double-flow steam turbine and which construction is useful to provide additional setback in both new double-flow steam turbines as well as double-flow steam turbines in-service which have been damaged by solid particle erosion. According to the present invention, the new and improved reheat tub includes, as two of its three parts, first and second discrete annular diaphragms each comprised of inner and outer rings and a plurality of circumferentially spaced nozzles extending radially between the inner and outer rings. The third part of the new and improved three-part reheat tub according to the present invention includes an inner cylinder or annulus which, in assembly, spans axially between the first and second diaphragms. It will be appreciated that each diaphragm is comprised of a plurality of arcuate segments assembled end to end to form the complete annular diaphragm. Thus, each annular diaphragm comprises two or more arcuate diaphragm segments connected endwise to one another. Similarly, the inner cylinder or annulus is comprised of two or more arcuate segments connected end to end to one another to form the cylinder. Preferably, however, each segment extends for approximately 180°. Thus, each diaphragm is preferably formed of two arcuate diaphragm segments and the inner cylinder is formed of two arcuate inner cylinder segments. It will be understood, therefore, that the reheat tub is comprised of a three-part construction, two discrete diaphragms spaced axially one from the other by a third part, i.e., the inner cylinder, and that each of the parts is formed of two or more arcuate segments.

The three-part reheat tub hereof can be dimensioned, for use in a new turbine to provide a predetermined setback (increased in comparison with conventional setbacks) and can also be used to refurbish in-service turbines damaged by solid particle erosion to provide an additional setback in comparison with the setback originally provided the turbine. Thus, for new turbines, the reheat tub is formed in three discrete parts, i.e., discrete first and second annular diaphragms and a discrete inner cylinder, with the parts being originally dimensioned to provide the necessary additional setback to minimize or eliminate the solid particle erosion problem in the new double-flow steam turbine.

The three-part reheat tub design of the present invention is also particularly useful in refurbishing in-service double-flow steam turbines which have been damaged by solid particle erosion or otherwise. To accomplish this, the reheat tub of the in-service turbine is removed from the turbine. That is, the conventional one-piece cast tub, two-piece bolted tub, or two-piece saddle tub, as applicable, is removed from the damaged turbine. A new reheat tub comprised of entirely new parts formed in the three-part design hereof, may be installed in lieu of the damaged reheat tub. These new parts including the new discrete first and second diaphragms and new inner cylinder may be dimensioned to provide the additional setback and for fit within the existing turbine. While installation of entirely new parts of the three-piece design may be used, cost and other considerations indicate that at least some elements of the removed and damaged reheat tub may be refurbished and reused in the refurbished tub construction.

To accomplish this, each arcuate section of the removed and damaged reheat tub is cut generally along radial and axially extending part lines into three pieces, namely, an inner cylindrical portion and two diaphragm segments, each diaphragm segment including inner and outer ring portions and radially extending nozzles between the inner and outer ring portions. The nozzles of the removed diaphragm segments may then be refurbished to repair the damage caused by solid particle erosion. Particularly, each nozzle may be repaired by adding material to it, such as by welding or by the installation of a pre-formed coupon, and subsequently machining the added material to the appropriate shape such that the original nozzle design may be obtained.

As part of the refurbishing of the diaphragms, the inner ring of each diaphragm segment is machined to remove material along its inner surfaces. Particularly, an arcuate flange or hook facing in the downstream direction is machined into each of the removed diaphragm segments. The inner face of the hook is tapered for reasons which will become clear. Material is also removed along the upstream seal face of the inner ring such that, in Dater assembly, the diaphragm segments can be assembled and the spacing between the trailing edges of the nozzles and the leading edges of the turbine buckets can be increased. Material is added on the downstream arcuate face of each diaphragm segment and a new circumferential spill strip is supplied. With respect to the outer ring of the diaphragm, the stepped axially upstream face of each of the outer ring segments are machined to remove material to permit the outer diaphragm ring to be setback and fit within the turbine housing slot. Along the downstream face of each diaphragm, an annular, outwardly directed groove is machined into the outer ring segments to receive a patch ring segment. The patch ring segment has sufficient thickness in the axial direction to equal or exceed the extent of the desired axial setback of the diaphragm relative to the turbine bucket. The downstream face of the patch ring can then be machined to the required spacing. While the patch ring is welded to the outer diaphragm segments, the use of weld material to build up the outer ring to accommodate the setback is eliminated.

Additionally, the dovetail grooves formed along the interior surfaces of the outer rings of the diaphragm segments are enlarged in an axial downstream direction. Axially enlarged tongues with spill strips formed thereon are provided in the enlarged grooves, the spill strips provided being spaced axially downstream a distance substantially equal to the desired setback. In this manner, the outer circumferential spill strips will overlie and seal with the bucket tips notwithstanding the setback.

The inner cylindrical portion or annulus of the damaged reheat tub is replaced by a newly fabricated inner annulus comprised of at least a pair of arcuate inner segments. Each annular segment of the new annulus has an axially downstream projecting hook having an arcuate tapered inner face for mating engagement with the newly machined tapered face on the inner ring segments on the diaphragm. Additionally, crush pins are provided on the end face of the annular segments.

To assemble the refurbished diaphragms and annulus, the segments of the diaphragms are rolled into the segments of the annulus in an endwise fashion, with the hooks sliding relative to one another. When, for example, the bottom half of the annulus has the axially opposite diaphragm segments completely rolled into the annular segments, keys are disposed in complementary shaped recesses at the intersection of the hooks in the end faces at the horizontal joint line and secured to prevent relative rotational movement of the diaphragms and annulus. With each annulus segment and its diaphragm segments in sub-assembly, the two sub-assemblies can be bolted together to form a complete reheat tub for the turbine.

Where a new turbine having hooks formed on the annulus and diaphragms has been in-service and requires refurbishing, the crush pins are cut to provide a clearance gap between the opposed end faces of the annulus and the inner ring of the diaphragm. Each diaphragm can then be knocked, i.e., displaced, in an axial upstream direction to free the tapered surfaces of the hooks from one another, enabling the diaphragm segments to be rotated or rolled from the annulus. In this manner, the diaphragms are readily removed from the annulus for refurbishing.

In a preferred embodiment according to the present invention, there is provided in a double-flow steam turbine having an axis, first-stage rotors spaced axially one from the other, a reheat tub disposed between the first-stage rotors and including first and second arcuate diaphragms axially spaced one from the other and disposed about the turbine axis, each diaphragm having an outer ring, an inner ring and a plurality of nozzles circumferentially spaced one from the other about the axis and between the outer and inner rings whereby the nozzles of the axially spaced diaphragms define steam paths in generally axially opposite directions relative to one another, the nozzles having trailing edges spaced a predetermined axial distance from the rotors, and an inner annulus disposed about the axis and extending axially between the inner rings of the axially spaced diaphragms; the improvement wherein the first and second diaphragms each comprise arcuate diaphragm segments each including a portion of the inner ring, the inner ring portion having a flange directed generally axially away from the annulus, the annulus comprising discrete arcuate segments with each segment including a flange directed generally axially toward the annulus, the flanges engaging one another to maintain the diaphragm segments and the annulus segments in assembly with one another.

In a further preferred embodiment according to the present invention, there is provided in a double-flow steam turbine having an axis, first-stage rotors spaced axially one from the other, a reheat tub disposed between the first-stage rotors and including first and second arcuate diaphragms axially spaced one from the other and disposed about the turbine axis, each diaphragm having an outer ring, an inner ring and a plurality of nozzles circumferentially spaced one from the other about the axis and between the outer and inner rings whereby the nozzles of the axially spaced diaphragms define steam paths in generally axially opposite directions relative to one another, the nozzles having trailing edges spaced a predetermined axial distance from the rotors, and an inner annulus disposed about the axis and extending axially between the inner rings of the axially spaced diaphragms; the improvement wherein the first and second diaphragms each comprise arcuate diaphragm segments, means for establishing a spacing between trailing edges of the nozzles of the segments and the rotors greater than the predetermined axial distance while maintaining the axial distance between the rotors constant, the arcuate diaphragm segments each including a portion of the outer ring, a patch ring secured on a downstream side of the outer ring portion and having an axial extent substantially the same as the difference between the predetermined axial distance and the greater spacing for accommodating the greater spacing.

In a further preferred embodiment according to the present invention, there is provided in a double-flow steam turbine having first-stage rotors and a damaged double-flow reheat tub including a pair of axially spaced diaphragms and an inner annulus spanning between the diaphragms, a method of retrofitting a reheat tub with increased setback of diaphragms relative to the first-stage rotors comprising the steps of removing the damaged reheat tub from the turbine, providing a reheat tub with increased setback having at least three discrete parts including (i) first and second arcuate diaphragm segments each having inner and outer ring portions, a plurality of circumferentially spaced nozzles therebetween, and hook portions on the inner ring portions and (ii) an inner annular segment having at opposite ends hook portions generally complementary to the hook portions of the inner ring portions and assembling the reheat tub with increased setback of the nozzles relative to the respective axially adjacent first-stage rotors by relatively rotating the diaphragms and the annular segment to engage the respective hook portions thereof thereby to secure the diaphragm segments and the inner segment one to the other with the diaphragm segments spaced axially one from the other along the inner segment.

BEST MODE FOR CARRYING OUT THE INVENTION

Figure 1:
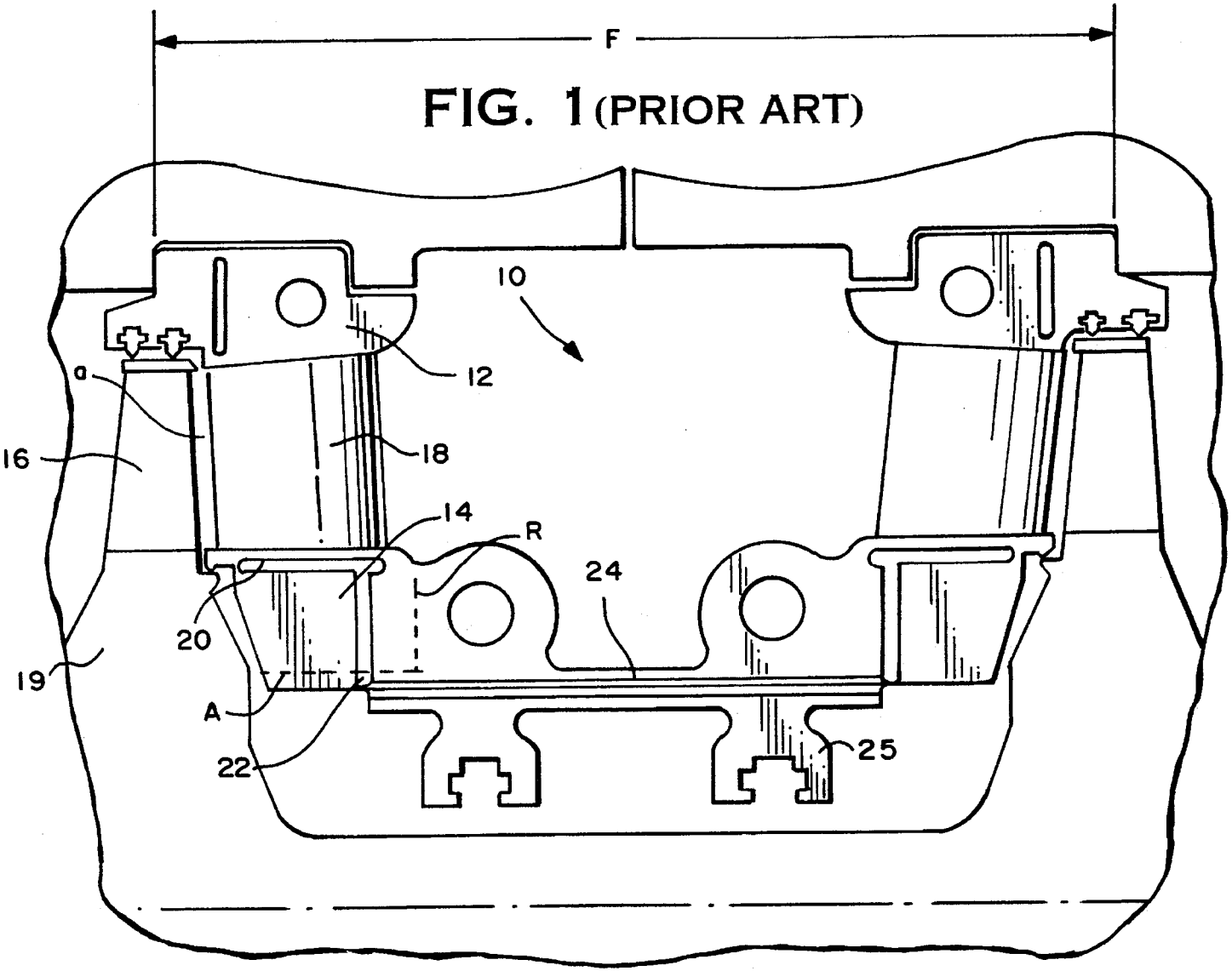
FIG. 1 (PRIOR ART)
FIG. 1 is a fragmentary elevational view of a path of a prior art reheat tub forming part of a double-flow steam turbine.

Referring now to FIG. 1, there is illustrated a portion of a conventional reheat tub, generally designated 10, for a double-flow steam turbine. Reheat tub 10 includes two or more arcuate sections, each including a diaphragm segment having an outer ring portion 12, an inner ring portion 14 and a plurality of circumferentially spaced nozzles 18 extending generally radially between the outer and inner ring portions 12 and 14, respectively. In this prior art construction, each arcuate tub section may comprise an integral one-piece casting or a pair of castings substantially forming mirror-images of one another and bolted together along a plane substantially normal to the axis of the turbine. In FIG. 1, the nozzles 18 are illustrated at a predetermined axial spacing "a" relative to the buckets 16 of the first-stage rotor 19. As illustrated, the end faces of the tub are provided with key slots 20 and 22 for receiving seals when the arcuate segments of the tub are assembled to prevent steam leakage. Inner cylinder 24 is provided with a pair of inwardly extending axially spaced dovetails 25 for connecting with rotor seal packing, not shown. As indicated previously, solid particle erosion, particularly with respect to the trailing edge of the nozzles 18, may be minimized or eliminated by increasing the axial spacing "a" between the nozzles and buckets of the first stage.

Figure 2:
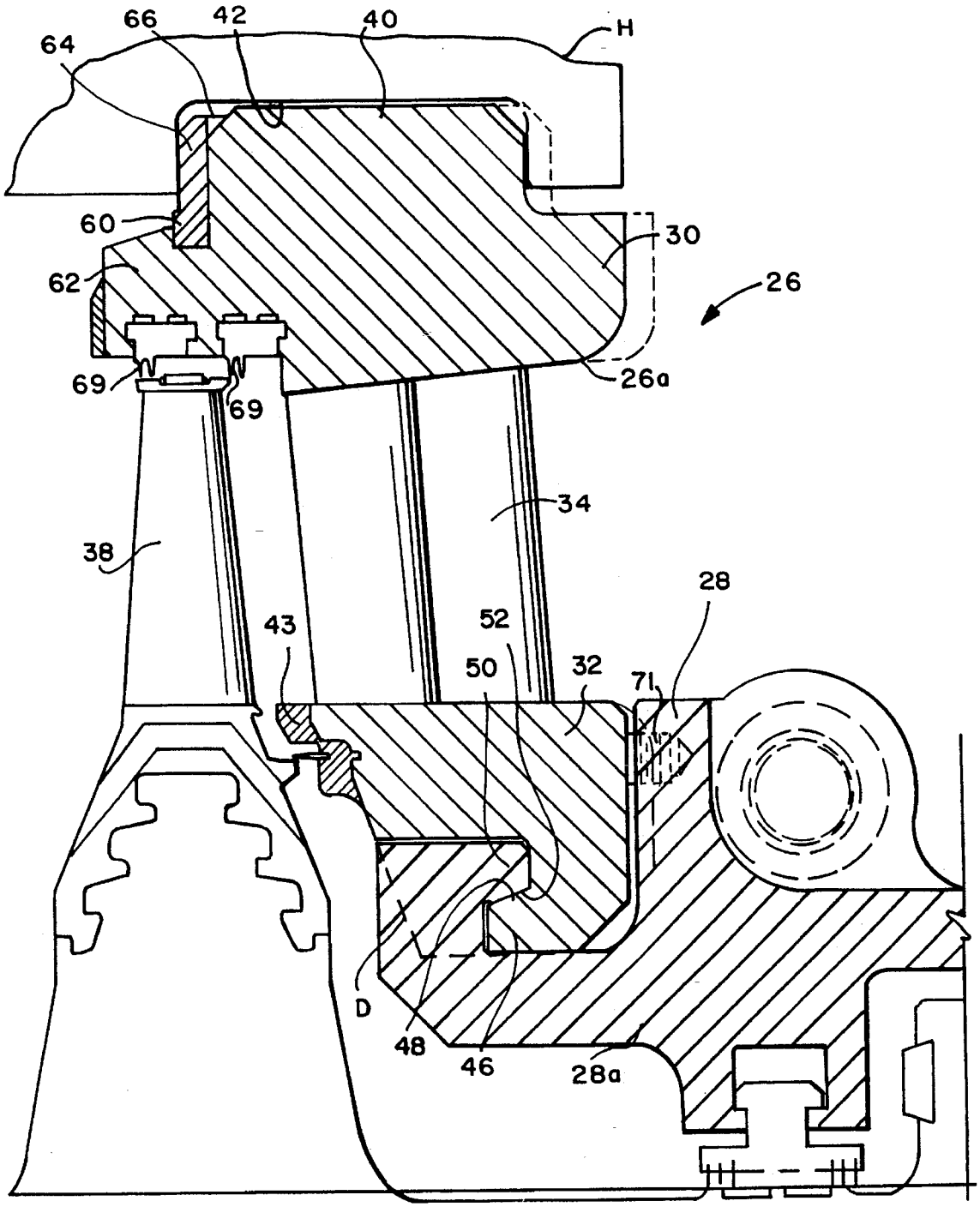
FIG. 2 is an enlarged fragmentary view with parts in cross-section of a diaphragm and its fit with an annulus on one side of the reheat turbine as refurbished.

Referring now to FIG. 2, there is illustrated a three-part reheat tub construction in accordance with the present invention. The first two parts comprise a pair of diaphragms 26, only one of which is shown on one axial side of a central annulus 28. Each diaphragm 26 includes a plurality of arcuate diaphragm segments assembled to form the annular diaphragm. That is, each segment **26*a* forms a portion of an annular array of similar segments which form the diaphragm. Each segment 26*a* includes an outer ring portion 30, an inner ring portion 32 and a plurality of nozzles 34 circumferentially spaced one from the other about the segment and extending generally radially between the outer and inner ring portions 30 and 32**, respectively.

The third part of the three-part construction of a reheat tub according to the present invention includes an inner cylinder or annulus 28 comprised of a plurality, preferably a pair, of arcuate inner cylindrical segments **28*a*. Each inner segment has an axial extent spanning between diaphragm segments 26*a* and when assembled in an annular array, the inner segments 28*a* define with the outer shell or housing H of the turbine and the diaphragms 26, the inlet torus for supplying steam through nozzles 34 to the buckets 38** of the first-stage rotors.

Each outer ring portion 30 has a radially outwardly projecting flange 40 for reception within a corresponding groove 42 of the turbine housing which serves, among other purposes, to locate the nozzles relative to the buckets.

In accordance with the present invention, means are provided cooperable between each of the diaphragm segments, particularly the inner rings thereof, and the annulus 28 for securing the diaphragm segments and the annulus segments one to the other. As illustrated in FIG. 2, the inner ring of the diaphragm may be provided with an arcuate flange or hook 46 having a tapered interior surface 48 extending axially in a downstream direction. A mating hook portion 50 is carried on annulus 28 and projects axially in an upstream direction. Hook portion 50 has a tapered face 52 complementary to the tapered face 48 on the hook portion 46 of the inner ring segment. Thus, the hook portions 46 and 50 engage one another along their complementary tapered surfaces 48 and 52 in final assembly.

When a reheat tub of an in-service turbine has been damaged, necessitating its replacement, it is desirable to provide additional setback for the diaphragms, such as those illustrated in FIG. 2, to minimize the solid particle erosion problem. To accomplish this, the diaphragms are cut along generally axial and radial partlines indicated by the dashed lines A and R in FIG. 1 to separate the damaged diaphragm portions from the inner cylindrical portion 24. The nozzles of each separated diaphragm segment may then be refurbished to eliminate the erosion caused by the solid particles and disposed in the new reheat tub with additional setback.

To provide the additional necessary setback while simultaneously providing use of the grooves 42 in the turbine shells as locating grooves, material is removed from the axially upstream faces of the outer and inner ring portions of the diaphragm. The extent of the removal of the material is indicated by the dashed lines in FIG. 2. Additionally, the interior portion of the inner ring segment 32 is machined to remove material, e.g., along the dashed lines D, leaving the inner surface in the form of the illustrated hook 46 with tapered surface 48. Additionally, the axially downstream face of the inner ring segments are provided with additional weld material to support the inner circumferential spill strip, as illustrated at 43 by the closely spaced cross-hatching. With respect to the outer diaphragm segments, an outwardly directed arcuate groove 60 is formed in the axially downstream projecting flange 62 of the outer ring portion of the diaphragm. A segment of an annular patch ring 64 is disposed in the groove and welded to the outer ring at 66. The thickness of the patch ring 64 is at least equal to the desired axial setback of the diaphragms from the buckets.

Additionally, where the outer ring forms part of an in-service diaphragm, the inwardly directed spill strips adjacent the turbine bucket tip are typically coupled to the outer ring by a tongue-and-groove arrangement. To relocate those circumferential outer spill strips consistent with the setback, an additional pair of rings mounting spill strips 69 are provided. The spill strips 69 have an axial extent corresponding to the axial extent of the groove previously extant in the outer ring and the desired setback. In this manner, the interior surface of the outer ring segment adjacent each groove can be machined to accommodate the axially enlarged spill strip securing rings whereby the latter can be placed in the enlarged grooves to axially accurately locate the spill strips 69, as illustrated.

Figure 3:
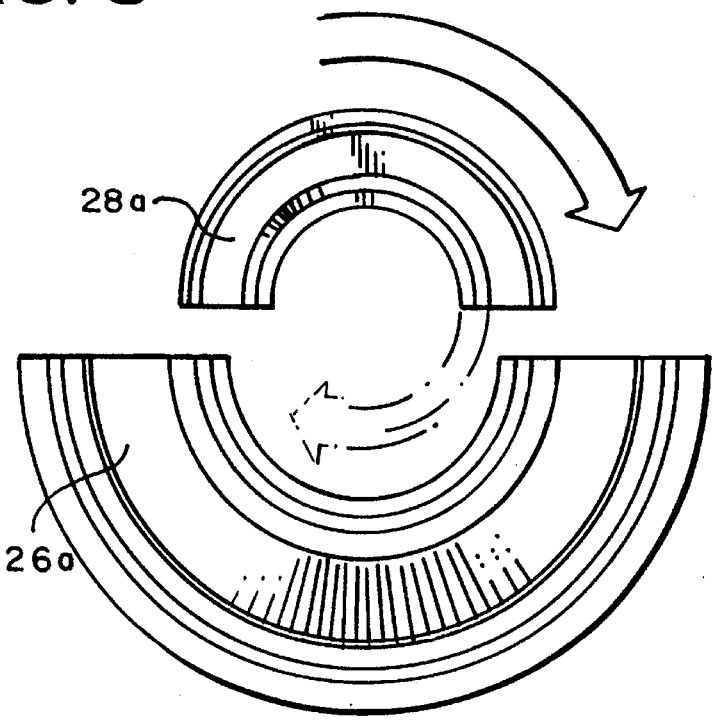
FIG. 3 is an end view of an annular segment of a tub and a diaphragm illustrating the manner of connecting those elements to one another.
Figure 4:
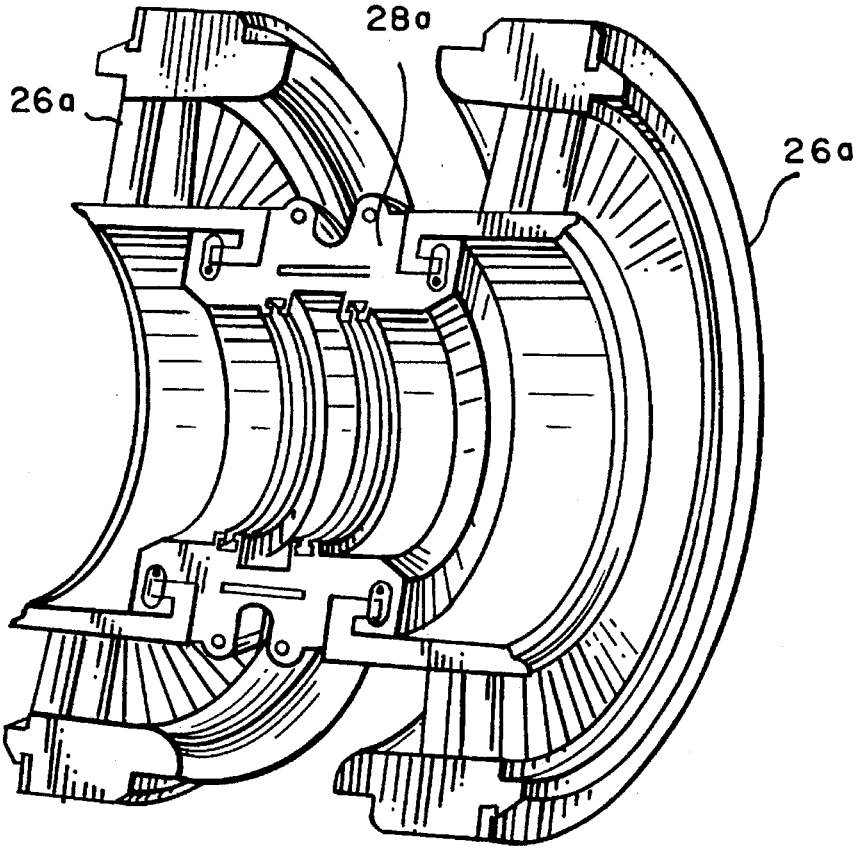
FIG. 4 is a perspective view of one half of a reheat turbine constructed in accordance with the present invention.

To assemble the refurbished reheat tub into the turbine, a pair of refurbished or new diaphragm segments, preferably 180° in length, are secured to an annulus segment, as illustrated with reference to FIGS. 3 and 4. To accomplish this, an end face of each diaphragm segment **26*a* is aligned with an end face of an annular segment 28*a* such that the hook portions may be receivable one within the other. By relatively rotating the diaphragm and annulus segments, the diaphragm and annulus segments can be assembled to provide a complete 180° sub-assembly, as illustrated in FIG. 4**, of one-half of the reheat tub. The end faces of the diaphragm and annulus segments are recessed to receive complementary-shaped locking keys secured to overlie both end faces, thereby preventing relative rotation of the diaphragm and the annulus segment. When the other half of the assembly is similarly assembled, the two sub-assemblies may be joined one to the other, for example, by bolting along a horizontal partline.

The present invention also provides for the ready disassembly of the diaphragms relative to the annulus, should that be necessary for refurbishing the nozzles. To accomplish this, the crush pins 71 are cut to provide a gap between the opposed axial faces of the diaphragms and the annulus. By tapping or knocking the diaphragm axially toward the annulus, the tapered surfaces 48 and 52 of the hooks 46 and 50, respectively, disengage from one another and permit the diaphragm segments to be rolled from the annulus segment to disassemble the diaphragm from the annulus.

A tub modified as described above can be placed into another turbine which may have a different sized F dimension, shown in FIG. 1. When the dimension F is smaller in the other turbine, the patch rings 64 can be machined to fit the grooves 42 in the housing H of the other turbine. When the dimension F is larger in the other turbine, the patch rings 64 can be removed by releasing seal weld 66, and installing new patch rings 64, for example by weld 66, having additional thickness to sealably fit within dimension F of grooves 42. The fit of the patch rings 64 in the housing H provides the steam seal between the tub and the housing H. During operation of the turbine, steam pressure deflects the diaphragm segments **26*a*** to provide a steam seal against leakage.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a double-flow steam turbine having an axis, first-stage rotors spaced axially one from the other, a reheat tub disposed between said first-stage rotors and including first and second arcuate diaphragms axially spaced one from the other and disposed about said turbine axis, each said diaphragm having an outer ring, an inner ring and a plurality of nozzles circumferentially spaced one from the other about said axis and between said outer and inner rings whereby the nozzles of said axially spaced diaphragms define steam paths in generally axially opposite directions relative to one another, said nozzles having trailing edges spaced a predetermined axial distance from said rotors, and an inner annulus disposed about said axis and extending axially between said inner rings of said axially spaced diaphragms; the improvement wherein said first and second diaphragms each comprise arcuate diaphragm segments each including a portion of said inner ring, said inner ring portion having a flange directed generally axially away from said annulus, said annulus comprising discrete arcuate segments with each segment including a flange directed generally axially toward said annulus, said flanges engaging one another to maintain said diaphragm segments and said annulus segments in assembly with one another.

2. A double-flow steam turbine according to claim 1 wherein said flange on at least one segment of said diaphragm segments and said annulus segments extend substantially continuously the full arcuate length of said one segment.

3. A double-flow steam turbine according to claim 1 wherein said flanges have surfaces in engagement with one another in said assembly, each of said surfaces having a taper extending axially toward said annulus and radially outwardly of the turbine.

4. A double-flow steam turbine according to claim 3 including crush pins between said inner ring portion and said annulus defining a clearance space therebetween.

5. A double-flow steam turbine according to claim 1 including means for establishing a spacing between trailing edges of the nozzles of said segments and said rotors greater than said predetermined axial distance while maintaining the axial distance between said rotors constant, said arcuate diaphragm segments each including a portion of said outer ring, a patch ring secured on a downstream side of said outer ring portion and having an axial extent substantially the same as the difference between said predetermined axial distance and said greater spacing for accommodating said greater spacing.

6. A double-flow steam turbine according to claim 1 wherein said flanges have surfaces in engagement with one another in said assembly, each of said surfaces having a taper extending axially toward said annulus and radially outwardly of the turbine, including means for establishing a spacing between trailing edges of the nozzles of said segments and said rotors greater than said predetermined axial distance while maintaining the axial distance between said rotors constant, said arcuate diaphragm segments each including a portion of said outer ring, a patch ring secured on a downstream side of said outer ring portion and having an axial extent substantially the same as the difference between said predetermined axial distance and said greater spacing for accommodating said greater spacing.

7. In a double-flow steam turbine having an axis, first-stage rotors spaced axially one from the other, a reheat tub disposed between said first-stage rotors and including first and second arcuate diaphragms axially spaced one from the other and disposed about said turbine axis, each said diaphragm having an outer ring, an inner ring and a plurality of nozzles circumferentially spaced one from the other about said axis and between said outer and inner rings whereby the nozzles of said axially spaced diaphragms define steam paths in generally axially opposite directions relative to one another, said nozzles having trailing edges spaced a predetermined axial distance from said rotors, and an inner annulus disposed about said axis and extending axially between said inner rings of said axially spaced diaphragms; the improvement wherein said first and second diaphragms each comprise arcuate diaphragm segments, means for establishing a spacing between trailing edges of the nozzles of said segments and said rotors greater than said predetermined axial distance while maintaining the axial distance between said rotors constant, said arcuate diaphragm segments each including a portion of said outer ring, a patch ring secured on a downstream side of said outer ring portion and having an axial extent substantially the same as the difference between said predetermined axial distance and said greater spacing for accommodating said greater spacing.

8. In a double-flow steam turbine having first-stage rotors and a damaged double-flow reheat tub including a pair of axially spaced diaphragms and an inner annulus spanning between said diaphragms, a method of retrofitting a reheat tub with increased setback of diaphragms relative to the first-stage rotors comprising the steps of:

removing the damaged reheat tub from the turbine;

providing a reheat tub with increased setback having at least three discrete parts including (i) first and second arcuate diaphragm segments each having inner and outer ring portions, a plurality of circumferentially spaced nozzles therebetween, and hook portions on said inner ring portions and (ii) an inner annular segment having at opposite ends hook portions generally complementary to the hook portions of said inner ring portions; and assembling said reheat tub with increased setback of said nozzles relative to the respective axially adjacent first-stage rotors by relatively rotating said diaphragms and said annular segment to engage the respective hook portions thereof thereby to secure said diaphragm segments and said inner segment one to the other with said diaphragm segments spaced axially one from the other along said inner segment.

9. A method according to claim 8, including the steps of forming said discrete first and second arcuate diaphragm segments by separating the diaphragm portions of the removed and damaged reheat tub from said inner cylindrical portion thereof, and refurbishing the separated diaphragm portions to form said first and second diaphragm segments whereby the assembled reheat tub with increased setback includes diaphragm segments formed from the diaphragm portions of the removed and damaged reheat tub.

10. A method according to claim 8, wherein said first and second arcuate diaphragm segments and said inner annular segment are different from said axially spaced diaphragms and said inner annulus of the removed and damaged reheat tub.

11. A method according to claim 9 wherein the diaphragms separated from the removed and damaged reheat tub include said inner and outer ring portions, each said inner and outer ring portions including upstream and downstream end faces, and including the further step of adding discrete patch rings to the downstream end faces of said outer ring portions, respectively, whereby the patch rings form the downstream end faces of said outer ring portions.

12. A method according to claim 11 including the step of removing material from the upstream end faces of said outer ring portions.

13. A method according to claim 8 including providing crush pins between said annular segment and said diaphragm segments to space said annular segment from said diaphragm segments.

14. A method according to claim 13 including removing said crush pins to create a clearance between said annular segment and said diaphragms and forming said hook portions with tapered surfaces such that, in assembly, said diaphragms are axially movable to close said clearance spaces.

* * * * *